US006554679B1

(12) United States Patent
Shackelford et al.

(10) Patent No.: US 6,554,679 B1
(45) Date of Patent: Apr. 29, 2003

(54) INTERACTIVE VIRTUAL CHARACTER DOLL

(75) Inventors: Judy Shackelford, Beverly Hills, CA (US); Ryan Slate, Trabuco Canyon, CA (US); David Okada, Manhatan Beach, CA (US)

(73) Assignee: Playmates Toys, Inc., Costa Mesa, CA (US)

( * ) Notice: Subject to any disclaimer, the term of this patent is extended or adjusted under 35 U.S.C. 154(b) by 0 days.

(21) Appl. No.: 09/240,287

(22) Filed: Jan. 29, 1999

(51) Int. Cl.[7] ..... A63H 3/00
(52) U.S. Cl. ..... 446/268; 446/297; 463/46
(58) Field of Search ..... 496/72, 268, 295, 496/296, 297, 302, 304; 463/1, 46, 35, 36

(56) References Cited

U.S. PATENT DOCUMENTS

| | | | | |
|---|---|---|---|---|
| 3,514,899 | A | | 6/1970 | Bonanno et al. |
| 4,075,782 | A | | 2/1978 | Neuschatz |
| 4,249,338 | A | | 2/1981 | Wexler |
| 4,516,950 | A | | 5/1985 | Berman et al. |
| 4,565,536 | A | | 1/1986 | Vairo |
| 4,646,350 | A | | 2/1987 | Batra |
| 4,696,653 | A | | 9/1987 | McKeefery |
| 4,710,145 | A | | 12/1987 | Hall Vandis |
| 4,740,186 | A | | 4/1988 | Sirota |
| 4,809,335 | A | | 2/1989 | Rumsey |
| 4,820,233 | A | | 4/1989 | Weiner |
| 4,878,871 | A | | 11/1989 | Noto |
| 4,911,670 | A | | 3/1990 | McNicholas et al. |
| 4,917,647 | A | | 4/1990 | Wetherell et al. |
| 4,923,428 | A | | 5/1990 | Curran |
| 4,950,200 | A | | 8/1990 | Curran |
| 5,004,442 | A | | 4/1991 | Lemelson et al. |
| 5,037,345 | A | | 8/1991 | Nakayama |
| 5,073,140 | A | | 12/1991 | Lebensfeld et al. |
| 5,083,965 | A | | 1/1992 | Mayem |
| 5,092,810 | A | | 3/1992 | Kwan et al. |
| 5,250,003 | A | | 10/1993 | Ferre |
| 5,281,180 | A | | 1/1994 | Lam et al. |
| 5,324,225 | A | | 6/1994 | Satoh et al. |
| 5,607,336 | A | | 3/1997 | Lebensfeld et al. |
| 6,159,101 | A | * | 12/2000 | Simpson ..... 463/46 |

OTHER PUBLICATIONS

Description of Tomagotchi Toy obtained from Internet at http://members.aol.com/tamagucci/adopt.htm, May 1997.*
Micro Pet Webpage from www.virtualpet.com/vp/farm/micropet/micropet.htm; (date unknown).
Webpage entitled "Pocket Puppy takes on Tamagotchi", by Steve Barnes, Albany Times Union, published by Standard Times' South Coast Today; Aug. 4, 1997.

* cited by examiner

*Primary Examiner*—Sam Rimell
(74) *Attorney, Agent, or Firm*—Liu & Liu

(57) ABSTRACT

The interactive doll simulates the character of a live person or, in other embodiments a fantasy figure or animal, in essence, simulating a living being that possesses respective human or animal qualities: displaying specific needs, tenderness, intelligence and/or understanding. The doll contains a clock or other timekeeping device and thereby knows of the time of day. It automatically enters a sleep mode at a preset sleep time during which the playtoy remains quiet, and wakens at a preset hour of the day, issuing a verbal statement to let the player know it is time to again play. By issuing a sequence of verbal requests from time to time to the player to take action of various kinds on or with the doll, determines the player's compliance or noncompliance with each such request and issues a verbal message appropriate to such compliance or non-compliance. Some of the verbal requests made are of a kind that occur at a particular time of day in the life of the character being synthesized, such as a request for a food or beverage at breakfast time, lunch time or supper time. And, from time to time at its own initiative, the playtoy may issue verbal messages of affection to the player. That doll is accompanied by external objects that simulate a variety of foods, a beverage, medicine and the like, which the doll is to be applied by the player to the doll pursuant to specific verbal requests from the doll and the doll is able to identify those objects for enhanced interactive play with the player.

42 Claims, 3 Drawing Sheets

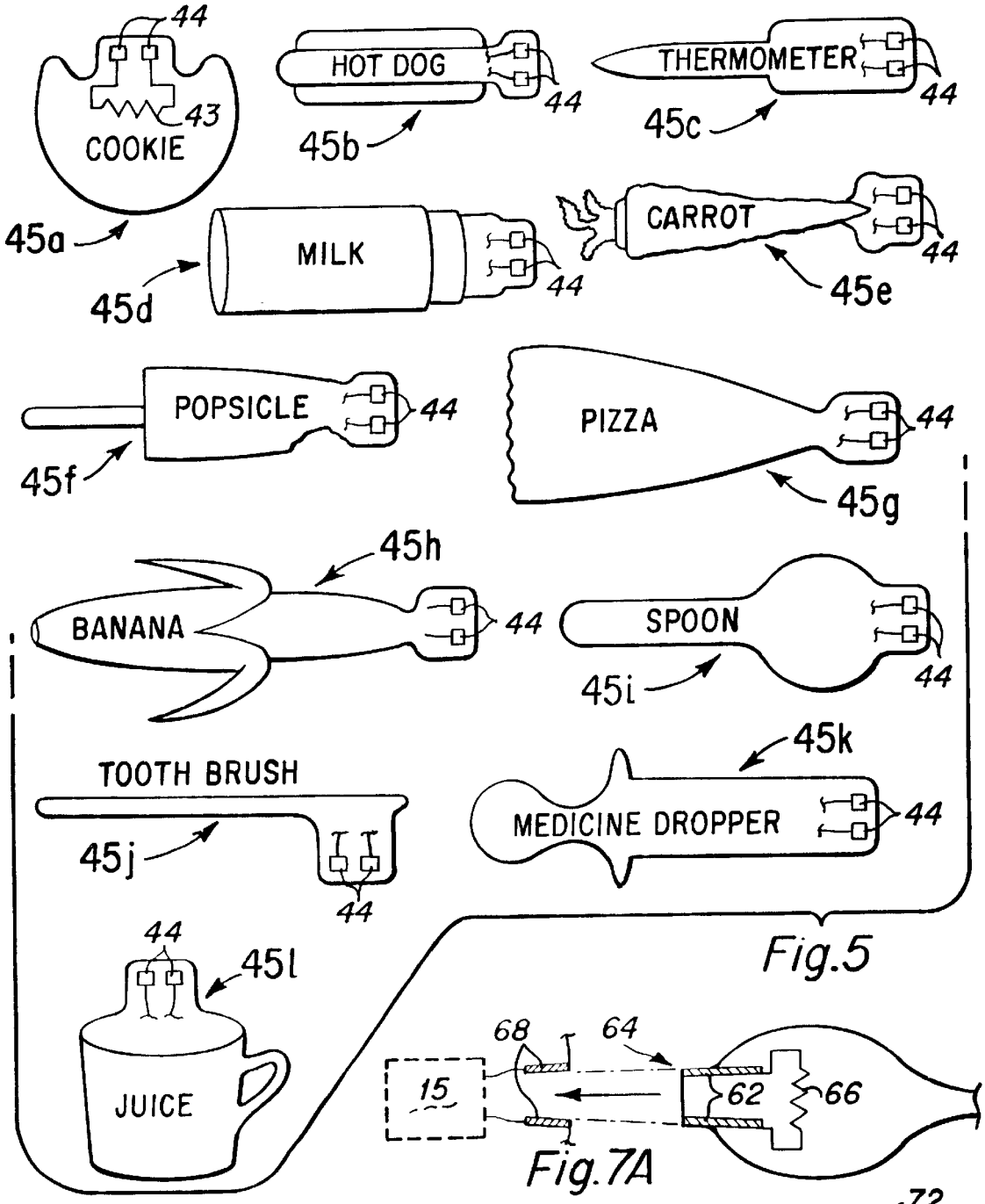
Fig.5
Fig.7A
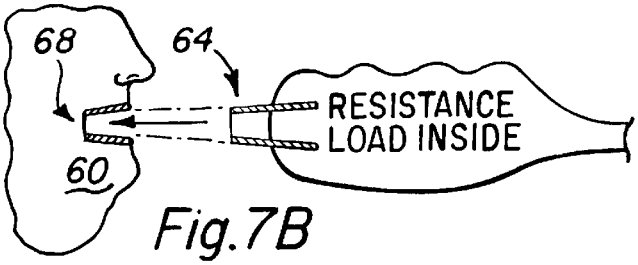
Fig.7B
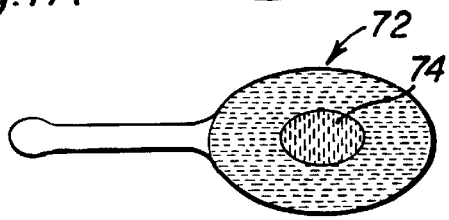
Fig.8

INTERACTIVE VIRTUAL CHARACTER DOLL

BACKGROUND OF THE INVENTION

1. Field of the Invention

The present invention relates to interactive toys, and particularly to interactive talking dolls.

2. Related Background Art

For centuries, toy dolls or action figures have enamored children of all ages. In their most basic forms, they have resembled the appearance of a person without life-like characteristics. Over the years, toy dolls and action figures have become much more sophisticated incorporating the latest technology to add qualities such as movement and speech. Previous toys have moved its arms, legs, and body and also recited pre-recorded words or phrases upon a child's touch such as squeezing. While the addition of such animated sequences enhanced children's enthusiasm for these toys, they did little to add a touch of life-like reality.

These toys share a common limitation, which is that, the interactions between the figures and the children are limited to a pre-defined set of scenarios such as hugging and laughing. In each interaction between the figure and child, the pre-defined scenario is repeated over and over. Prior art dolls have been incapable of initiating activities to solicit a child's response and recognizing various types of inputs which resemble real life activities so as to render a much more realistic life-like figure.

Developers of electronic toys have tried to enhance the concept of a more dynamic and realistic interaction between the child and the toy. Earlier hand-held interactive electronic games so-called "virtual pals" (and variations such as "virtual pets", "digital pets", etc.) generally comprise of small palm-size units having a liquid crystal display and a number of push buttons for user interactive inputs. The electronic game is programmed to simulate the growth of an animated character (e.g., an animal such as a dog, or a human such as a child) over an accelerated period. Specifically, the character is programmed to undertake certain simulated activities, such as eating, sleeping, playing, expressing emotions, falling sick, etc. The object of the game is for the player to periodically attend to the character's needs so as to raise the character successfully over a certain period of time.

The game unit has a display that displays information concerning, for example, the state of the game (e.g., welfare of the character, age, etc.), the character's animated expression and behavior, and the character's reaction to each user input. The character's activities, behaviors and interactions with the player are governed by a set of preprogrammed gameplay rules. The user selects and executes the activities by activating the buttons on the game unit, via an icon and/or menu driven based on-screen user interface. Specific interactions may include periodically feeding the child food and drinks when she is hungry, playing with the child to keep her happy, giving her medicine when she is sick, cleaning her when she is dirty, etc. The face of the child is displayed to show the expressions made by her face.

These games share a common limitation, which is that, the communications between the characters and players are limited to visual display of the characters and synthetic audio alarms or warning tones when certain events have been triggered. The display may be the only effective medium for communicating the status of the game and the state of the character to the player. The player must pick up the game unit and refer to the display to check the status of the character and game.

The "Talking-Nano," a virtual pal type electronic game developed by Playmates Toys, Inc., added audio speech capability to the earlier games and significantly improved realism of the hand-held games. It independently solicits input from the child. However, by the nature of a palm-sized game, it does not manifest the physical attributes of a character.

It is desirable to create a toy having a more natural form of interaction to render more realism in a virtual environment. This would add another dimension to the toy, such that player/toy interactivity and realism of the toy may be improved to increase a child's enjoyment.

SUMMARY OF THE INVENTION

The present invention provides a new dimension to the prior art interactive talking doll. Specifically, the present invention adds a dimension of interactive identification to the prior art interactive talking dolls. More specifically, the present invention recognizes various types of player inputs that resemble real life activities such as feeding, grooming, playing, dressing, etc. The present invention provides multi-stage interaction between the player and doll.

In one embodiment of the present invention, the interactive talking doll is programmed to simulate a child undertaking basic time-based daily activities and events that are pertinent to a child's life. Input means are provided to allow the player to interact with the doll. The input means includes various play-pieces and sensors. In accordance with one embodiment of the present invention, audio attributes comprising simulated natural sounds are synchronized with the doll's state of mind as it carries out its activities. The audio attributes may include messages, which may be specific words, phrases or sentences, or sound effects such as crying, whining, giggling, chewing, or drinking, which communicate to the player the doll's actions, thoughts, feelings and emotions, for example. Coupled with the ability to recognize various inputs from the player, the doll has the ability for multi-stage interaction. For example, if the doll demands one type of care or item but the player gives another type of care or item, the doll recognizes the mistake and verbally prompts for the correct interaction.

The doll, which may depict a child, adult, animal or fantasy figure, contains in a stand alone configuration, a clock for setting the time of day and/or time of year, a speech synthesizer, a non-volatile memory, a loudspeaker, a number of child actuated sensors distributed about the doll and an internally carried battery operated, preprogrammed microprocessor in which the microprocessor contains, a program which replicates a nurturing play pattern by causing the microprocessor to command issuance of spoken requests or verbal statements from the doll relating to things that are appropriate to want or to do at a specific time of day or randomly as may be expected throughout the day, and, through the check of the child actuated sensors, is able to ascertain that the child has responded to such requests; and, should the child fail to respond appropriately, exhibits to the child, through verbal statements issued, a state of health and/or happiness consistent with such failure to respond that mimics the state of health and happiness of a real child so neglected, and, through further check of the child actuated sensors, detects that the child has furnished appropriate medicine or affection to the doll, and issues verbal statements indicating recuperation.

As an added feature the program also causes the microprocessor to respond to child initiated activity when the child actuates a child sensor, without a spoken request for the child being issued from the doll, and to give an appropriate response to the child regarding the activity initiated thereby by the child.

Additionally the program keeps track of such child initiated activities through monitoring the sensors, translating the count thereof into a display representing the doll's state of healthiness and/or happiness.

As a further addition, the clock may be of the form of a programmable clock calendar. Birthday's, holidays, local seasons, religious holidays, or religious events and the like may be programmed into the calendar, and the microprocessor program to make a check of the calendar. The repertoire of stored verbal messages may include those which may be correlated to such events or occasions so as to be spoken by the doll on the appropriate day or in anticipation thereof.

The interactive doll simulates the character of a live person or, in other embodiments m a fantasy figure or animal, in essence, simulating a living being that possesses respective human or animal qualities: displaying specific needs, tenderness, intelligence and/or understanding. The doll contains a clock or other timekeeping device and thereby knows of the time of day. It automatically enters a sleep mode at a preset sleep time during which the playtoy remains quiet, and wakens at a preset hour of the day, issuing a verbal statement to let the player know it is time to again play. By issuing a sequence of verbal requests from time to time to the player to take action of various kinds on or with the doll, determines the player's compliance or noncompliance with each such request and issues a verbal message appropriate to such compliance or non-compliance. Some of the verbal requests made are of a kind that occur at a particular time of day in the life of the character being synthesized, such as a request for a food or beverage at breakfast time, lunch time or supper time. And, from time to time at its own initiative, the playtoy may issue verbal messages of affection to the player. That doll is accompanied by external objects that simulate a variety of foods, a beverage, medicine and the like, which the doll is to be applied by the player to the doll pursuant to specific verbal requests from the doll and the doll is able to identify those objects for enhanced interactive play with the player.

BRIEF DESCRIPTION OF THE DRAWINGS

FIG. 5 illustrates some of the sample play-pieces used in conjunction with the interactive talking doll .

FIG. 7A shows the top view of another embodiment of implementing contact between the play-piece and the doll's mouth.

FIG. 7B is the side view of FIG. 7A.

FIG. 8 illustrates another sample play-piece used in conjunction with the interactive talking doll.

DESCRIPTION OF THE ILLUSTRATED EMBODIMENT

The present description is of the best presently contemplated mode of carrying out the invention. This description is made for the purpose of illustrating the general principles of the invention and should not to be taken in a limiting sense. The scope of the invention is best determined by reference to the appended claims.

The present invention will be described in reference to doll which interacts with the player and implements a virtual human character, and in particular to the daily activities of a child. It is to be understood that other characters (real or fictitious) and even other figures or objects may be implemented in accordance with other simulations similar to the present invention without departing from the scope and spirit of the present invention.

Figure 1:
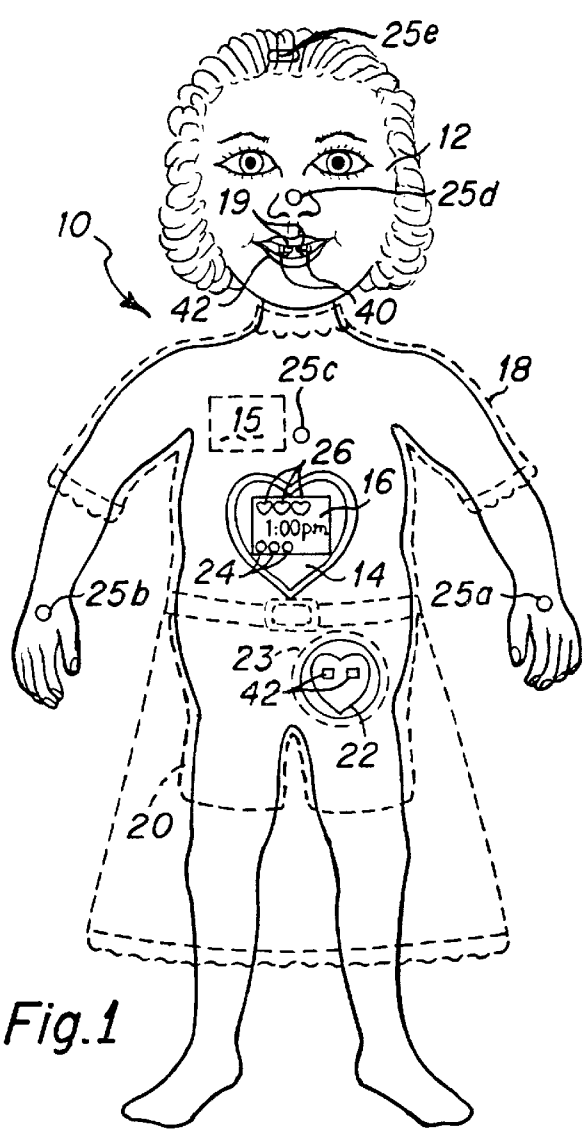
FIG. 1 is a schematic frontal view of the interactive talking doll in accordance with one embodiment of the present invention.

FIG. 1 is a schematic frontal view of one embodiment of the doll 10. The doll 10 has an outer shell 12 that is soft and made to resemble human skin. The shape of the doll 10 is not particularly important, but conforms with the proportions of a child. The overall size of the outer shell 12 is shaped and sized to allow the player (i.e., typically a child) to hold it in its arms without burden. As an example, the outer shell 12 may be shaped as shown in the drawings, and may have an overall dimension (height×width×thickness) in the order of about 20"×7"×3". The electronic components (including a real-time system clock 16) is housed on and/or within the body of the doll 10. The time kept by the real-time clock 16 can be seen by the player on a display panel 14. The real-time clock 16 informs the player of the time of day and appropriately controls the timing of the doll's daily needs such as eating lunch, taking naps, and going to bed. The doll 10 can accommodate various types of play-pieces including different outfits 18 ranging, for example, from pajamas to play clothing. Each outfit 18 is encoded with information identifying the particular outfit to the doll's control unit 15. Such information may be encoded in the form of a resistive value, digital or analog data, or other forms of coding.

Figure 2:
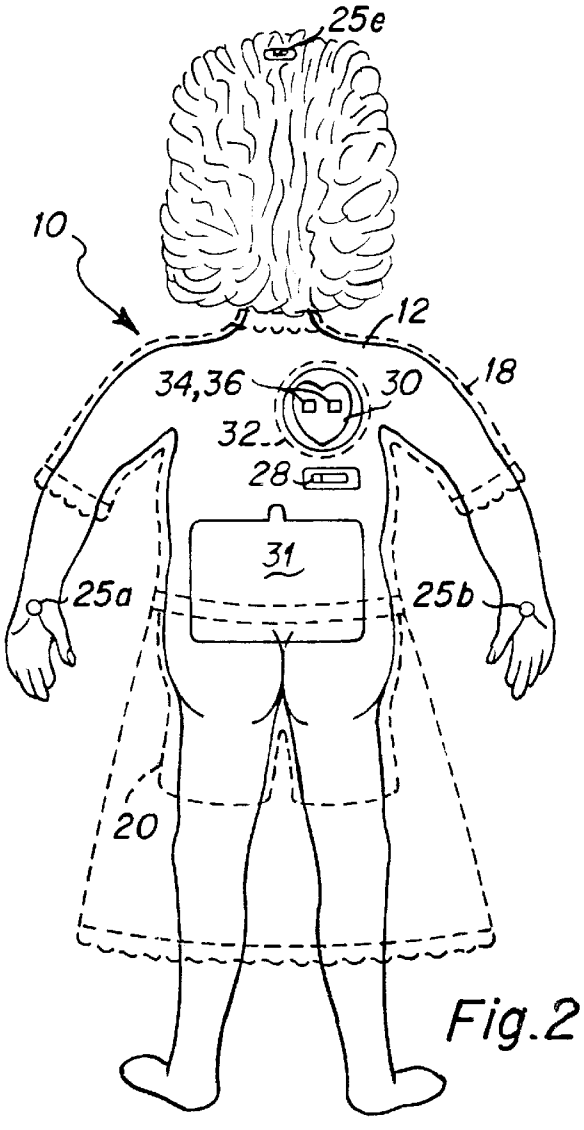
FIG. 2 is a schematic rear view of the interactive talking doll.
Figure 3A:
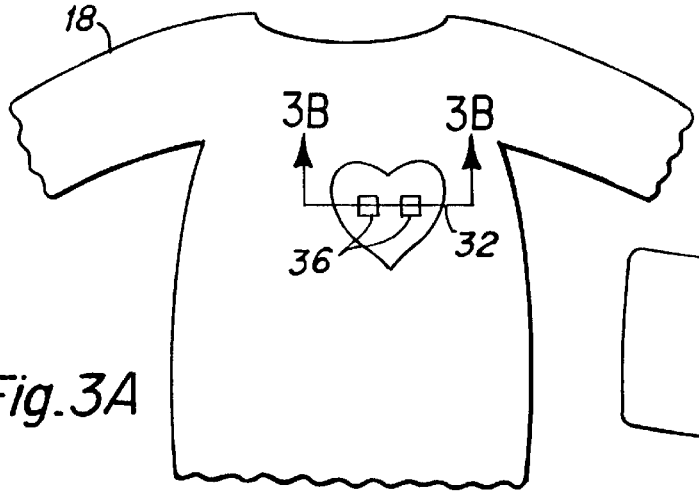
FIG. 3A shows the frontal view of the outfit resistor on an outfit.
Figure 3B:
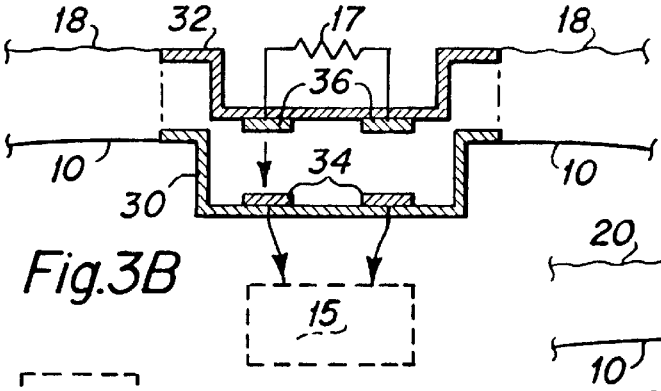
FIG. 3B is a sectional view taken along line 3B—3B in FIG. 3A.

Referring to FIG. 2, an outfit sensor 30 is located on the upper back of the doll 10. It functions to inform the doll's control unit 15, the encoding uniquely associated with the type of outfit the doll is wearing. The outfit sensor 30 is shown in a heart-shape, but it may take on other shapes. Referring to FIG. 3, each individual outfit 18 has a complementary shape plug 32 which has a built-in resistive element 17 having a resistance of certain value uniquely representing the particular outfit 18 and has two metal contacts 36 which match the corresponding contacts 34 of the outfit sensor 30. The resistive element is concealed in the plug 32. When the outfit 18 is placed on the doll, the outfit plug 32 is plugged into the outfit sensor 30. Through the outfit sensor 30, the resistance value is read by the controller unit 15 so as to identify the particular outfit. As illustrated in the cross-section diagram of FIG. 3B, the outfit plug 32 is configured as a male plug and the outfit sensor 30 a female socket that are coupled to bring the contacts 34 and 36 together. The fitting of the male plug and female socket may be relied on to secure the placement of the outfit 18 on the doll 10.

In a practical embodiment the male plug 32, containing the resistance coding a particular doll outfit, and female socket, with the sensor 30, are preferably in the shape of a heart formed of injection molded plastic, the male plug being slightly smaller in size to mate with the larger socket with a pressure or "snap-fit". Likewise diaper sensor 22 and male plug switch closer 23 attached to the doll are also of the same heart shaped injection molded plastic and "snap-fit" together. However the latter plastic casing is of a different size than that used for outfit plug 32, preventing the child from securing an incorrect attachment.

In play, the doll knows if the child has put on her pajamas in preparation for going to bed. And the doll can also know if the pajamas are taken off at some time in the morning and the doll is dressed for the day in, her dress or other play clothes. With different resistance values for different outfits, the doll thereby knows when another special outfit is put on her by the child. That special outfit may accompany a play pack, purchased separately from the doll, containing a variety of additional play pieces. Each such outfit and play piece will contain coding resistors that are of a different range of resistance values than those found in the outfits and playpieces accompanying the doll. With the microcontroller programmed to recognize such special outfits and playpieces, the doll will call upon speech in her stored memory appropriate for such playpieces or clothing. In the foregoing manner the doll's play pattern is expanded to additional themes and activities that are beyond the scope of play and conversation in the original purchase.

Figure 4A:
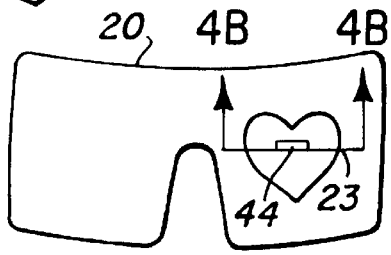
FIG. 4A shows the frontal view of the switch closer on the diaper.
Figure 4B:
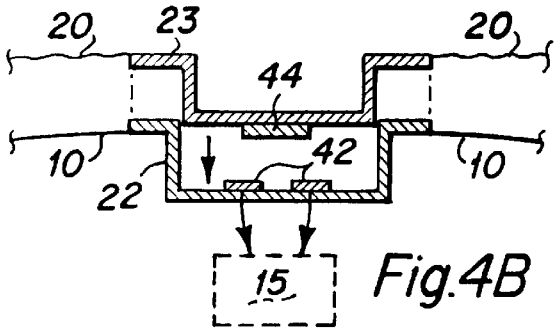
FIG. 4B is a sectional view taken along line 4B—4B in FIG. 4A.

Referring to FIG. 4A, the doll 10, under its outfit, wears a diaper 20 which is detected as being present on the body of the doll 10 by a diaper sensor 22. In this instance, unlike the outfit recognition based on different resistive values, the doll recognizes if she is wearing a diaper or not depending on simply whether the diaper sensor 22 forms a closed switch. As illustrated in the cross-section diagram of FIG. 4B, the switch closer 23 on the diaper is configured as a male plug and the diaper sensor 22 a female socket that are coupled to bring the contacts 42 and 44 together. The fitting of the male plug and female socket may be relied on to secure the placement of the diaper 20 on the doll 10. When not wearing a diaper 20, the two metal contacts 42 of the diaper sensor remain disconnected and thus forms an open circuit. However, when wearing a diaper 20, and the switch closer 23 on the diaper is snapped into the diaper sensor 22 on the doll, the single metal contact 44 on the switch, closer 23 closes the open switch of the diaper sensor 22. The controller 15 now recognizes that the doll 10 is wearing a diaper. Therefore, to the doll, an open switch indicates that the diaper is off, while a closed switch indicates that the diaper is on.

Figure 6A:
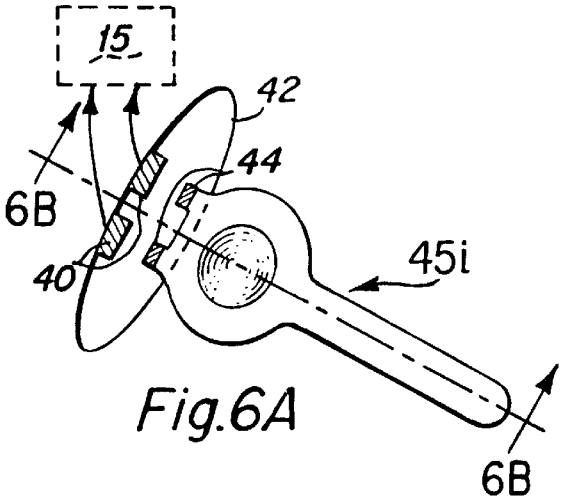
FIG. 6A shows the insertion of a play-piece into the doll's mouth.
Figure 6B:
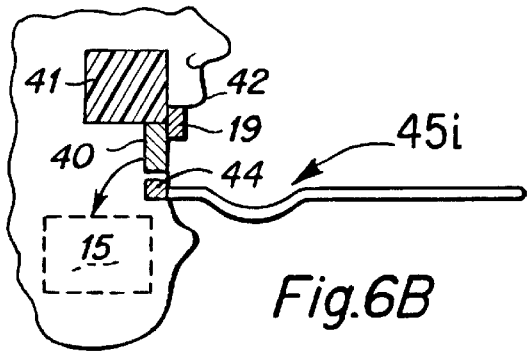
FIG. 6B is a sectional view taken along line 6B—6B in FIG. 6A.

Referring to FIG. 6A, in order to recognize and distinguish the various food and other items placed in its mouth 42, the doll 10 has a teeth sensor 40. The teeth sensor 40 may be metal contacts hidden behind the front teeth 19 of the doll with the tip of the contacts extending slightly beyond the tip of the teeth. Similar to the various outfits 18 of the doll 10, each item 45*a* through 45*l* depicted in FIG. 5, is an additional play-piece that has a built-in resistive element 43 having a resistance of certain value uniquely representing the particular play piece with two exposed contacts 44 that match the corresponding teeth sensor 40. As each item 45*a* through 45*l* in FIG. 5 is placed into the virtual doll's mouth, the contacts of the teeth sensor 40 comes into contact with the contacts 44. The controller 15 determines the different resistance values so as to identify each item. Referring to FIG. 6A, the two exposed contacts 44 must make a physical contact with the teeth sensor 40 in order for the doll 10 to determine the correct resistive load. Referring to FIG. 7A, another implementation of the contacts would be thin wedge male plastic forms with exposed metal contact strips 62 on the sides of the wedge tip 64. The resistors 66 themselves are concealed inside the play-piece. Referring to FIG. 7B, the mouth 60 has a corresponding female play-piece wedge form 68 with contacts hidden on the sides of the mouth, but with the contacts exposed above the surface. This mechanical wedging contact ensures an easier positive contact on both sides of the mouth , especially if top-bottom thickness of the male trapezoid is thin (e.g., ⅛"), giving an efficient sliding fit. The placement of the resistor within the individual play-pieces is not important. The resistor may be concealed within a play-piece, or may just sit on top of or on the side of the play-piece, fully or partially exposed and/or camouflaged. Instead of using resistive elements, recording or memory elements may be encoded with analog or digital data to represent the play-pieces. A suitable transducer may be used to read such data which is in turn interpreted by the control unit 15.

In a practical embodiment a injection molded relatively rigid plastic mouthpiece 41 is inserted into a cutout section inside the doll's head behind the doll's lips and teeth 19 formed of vinyl to provide a stationary support for the sensor, permitting the sensor to remain relatively stationary when the play pieces are inserted during play into the doll's mouth. The stationary nature of the mouthpiece helps ensure that the softness and pliable nature of the vinyl material used for the doll's head and face allows the resistors strategically molded at the end of the play piece will match up correctly with the mouth sensor in order for that sensor to easily and correctly measure the resistance value.

As mentioned earlier, the goal of developing a virtual toy is to make the interaction between the player and toy as real as possible. To further this goal, various sensors in the form of contact switches which activate upon the player's touch and thus recognizes physical interaction is placed throughout the body of the doll 10. The doll's left hand sensor 25*a*, right hand sensor 25*b*, chest sensor 25*c*, and nose sensor 25*d* are all activated by the player's squeezing or pressing motion. These sensors monitor the interaction between the player and doll. For example, the hand sensors 25*a* & 25*b* detect squeezing of the doll's hands, the chest sensor 25*c* detects hugging, and the nose sensor 25*d* detects the player's initiation to blow the doll's nose. In addition to detecting the squeezing action, the hand sensors 25*a* & 25*b* serve another purpose to set the doll's heart clock 16 on the display panel 14. By toggling between the squeezing of the left and right hands sensors 25*a* & 25*b*, the player sets the current time and the doll's wake-up and bed times. If no wake up or bed times are set by the user, the doll uses those default times established by the program.

To complement the feeding and dressing aspects, the doll has a grooming feature. The head sensor 25*e* may be a magnetic read switch. It interacts with a core center 74 that is made of a magnetic material, such as iron or a permanent magnet, provided in the hair brush 72 depicted in FIG. 7. When the player brushes the doll's hair, the hairbrush core center 74 grazes the head sensor 25*e*. As the hairbrush's core center 74 interacts with the head sensor 25*e*, the doll recognizes the grooming process.

Referring back to FIG. 1, in addition to the real-time clock 16 shown by the display panel 14, there are icons 24 and 26 which represent the various mood and health stages of the interactive virtual character doll, respectively. The smile icons 24 represent the happiness state of the doll while the heart icons 26 represent the doll's state of health. Referring back to FIG. 2, the on/off switch 28 controls the start of operation of the virtual character doll. The battery pack 31 houses the batteries needed for operation.

In the embodiment of the interactive virtual character doll, the object is to take care of the virtual doll just like one would tend to a real child. The doll undergoes daily processes typically experienced by a child, ranging from feeding, diaper changes, game playing, grooming, napping, teeth brushing, etc. If the player takes good care of the virtual character doll, she stays happy and healthy. If the player neglects the virtual character doll, she becomes unhappy, bored, and sick.

In a specific embodiment, the player turns the virtual child on via the on/off switch and sets the wake-up time and bedtime. In addition, the player sets the correct current time to keep track of the hours of the day. All time setting are adjusted by toggling between the squeezing of the left and right hands sensors. Once the time settings are complete, the doll wakes-up at the pre-set hour selected by the player and makes requests throughout the day. Alternatively, if the child attempts to play with the doll when in its sleep mode, such as by squeezing the doll or its hands or inserting a play pieces in the doll's mouth, the doll may be programmed to broadcast the message that it does not wish to play and that it wants to go to sleep.

The doll's requests are for the daily processes (eating, napping, playing games, changing diapers/clothes, etc.) mentioned above. At nighttime, the virtual character doll goes to bed (sleep) every night at the time the player has selected. After her bedtime, she will not interact nor play with the player until her pre-set wake-up time the next day. In this manner, the virtual character doll keeps track of time like a real-life child. In essence, one day of real time to the player represents one day to the virtual character doll as well. The virtual character doll repeats this daily ritual until the player turns off the doll via the on/off switch.

In accordance with the present invention, the virtual character doll is enabled to communicate audio attributes (e.g., words and sounds) to the player. From time to time, depending on the state of the doll's activities (i.e., the events and activities associated with the daily function of the virtual character doll), the doll would communicate to the player by way of sounds and words. The sounds and words are synchronized to the circumstances of the daily activity and the mood of the virtual character doll. Sounds play an important role to simulate the doll's eating and drinking activities as well as to express surprise, happiness, and sadness of the doll's mood. Speech is synchronized to respond to the player's interaction of the doll such as expressing thanks for proper care while expressing dislike for player's mistakes. For example, if the player gives the wrong food item upon the doll's prompt for a particular item, the doll responds with a sentence notifying the mistake.

In accordance with one embodiment of the present invention, the vocabulary of the virtual character doll comprises of about 150 words/phrases. The virtual character doll, however, is programmed to say the phrases in many different ways. Thus, the doll commands about 10,000 different ways of expressing ideas and thoughts in accordance with the circumstances of the situation. Some examples of the doll's vocabulary include:

"Mommy, I'm Hungry";

"Let's Play a Game";

"I Love You";

"Squeeze My Right Hand";

"Let's Have Milk Now";

"Mommy, I Want Some Carrots";

"Let's Have Some Banana";

"Mommy, My Tummy is Hungry";

"Mommy, Please Feed Me a Snack";

"Mommy, Please Change My Diaper";

"My Diaper, Yuk!, Time for a Change";

"Thank You";

"Am I Cute or What?"; and

"No Thank You! I Don't Want Pizza, I Want Some Milk Please".

The non-verbal natural sounds for certain interactive activities that can be made by the doll include:

"Gulp" (for drinking);

"Chomp Chomp" (for eating solid foods);

"Aahhh" (for thermometer);

"Dropper" (for medicine);

"Shh Shh Shh" (for teeth brushing);

"Innng Innng" (for crying);

"Woaw" (for expressing surprise); and

"Hee Hee Hee" (for giggling).

Other sounds and vocabulary may be included depending on the desired features, activities, events of the particular virtual interaction, and the personality and attributes of the virtual character.

The embodiment of the doll is programmed with several player interactive activities. The activities the player can do with the virtual child includes the following:

feeding her food;

giving her drink;

giving her medicine;

putting her to bed;

blowing her nose;

changing her diaper;

brushing her teeth;

brushing her hair;

hugging her;

squeezing her hands;

squeezing her nose;

taking her temperature;

changing her outfits; and playing games with her.

With the player, the doll can play games such as:

"Simon Says";

"Color Game"; and

"Squeeze Game."

The doll is the leader in "Simon Says." The player is suppose to do what she says, but only when the doll says, "Simon Says." In the "Color Game," the doll; asks the player to feed her the foods of different colors. The player is suppose to match the color of the food piece or spoon to the color the doll shouts out loud. In the "Squeeze Game," the doll challenges the player's memory. The doll asks the player to perform a series of activities—for example, "Blow my nose, squeeze my hand, give me a hug!" The player then must repeat all activities in the correct order to win. Additional activities may be programmed without departing from the scope and spirit of the present invention.

Throughout the day, the player's goal is to take care of the doll just like a real child. From the time the doll wakes up, she will tell the player to feed her, to play games with her, to change her diapers/clothing, and to take care of her. For example, the doll may demand milk upon waking up in the morning. The player is suppose to pick out the milk bottle among the many play-pieces and feed the doll. Upon the player's compliance with the doll's wishes, she will thank the player and proceed with other demands. This process continues throughout the day and the doll stays happy and healthy with such care. If, on the other hand, the player does not cater to the demands of the doll, she will repeat her needs multiple amount of times.

During the day, the doll naps at three different times. First, if the player has satisfied all of the doll's needs, she naps until she needs something else. Second, if the doll repeats a request five times in a row without a response from the player, she takes a long nap until someone wakes her, or until her wake-up time the next day. The player can wake up the doll by squeezing either hand, changing her diaper, touching her nose, brushing her hair, or hugging her. Third, the player can force the doll to nap by simultaneously squeezing her right hand and hugging her and holding that position for at least three seconds. This forces the doll to take a nap until the player wakes her, or until wake-up time the next day.

The doll is also programmed to communicate words and phrases to the player on its own as the day proceeds, the timing of which is governed by the gameplay rule set forth below. These communications are not in direct response to the player's input (i.e., the player does not directly trigger the response by touching or feeding the doll). Rather, such communications are dependent on cumulative factors and events, which may be caused by the player's interaction with the doll, system functions and activities. For example, the doll will say "Let's Play A Game" when her happiness level drops below a certain threshold, say "I'm Hungry" when her food level drops below a certain threshold, or say "I'm Sick" when her health level drops below a certain threshold. The happiness level is dependent on various factors, such as the amount of play, sleep, drink, food and medicine, and the elapsed time from the last time these activities were undertaken. The food level is dependent on the elapsed time from last feeding, which may affect the health and happiness level. The health level is also dependent on the kind and amount of food and medicine fed. The doll gives an outburst if she is not played with for a period of time, or when the general health and happiness level drops below a certain threshold because of lack of attention to her health, food and drink. Additional details of the relationships between various states and events are set forth in the gameplay rules set forth below.

Accordingly, the ability for the doll to independently communicate words and phrases to the user improves the realism of the doll. The triggering events for such communications are simulated to follow the natural attributes of a child. In essence, the player is responding to the needs of the doll, much like responding to the needs of a real child. There is no longer the monotonous repetition of a few simple sequences such as just hugging and giggling.

Other activities and events programmed in the embodiment of the doll are best understood by reference to the set of "gameplay rules" (game logic) and functions summarized below. These gameplay rules and functions simulate the activities, functions and events that are part of the natural attributes of a real child:

Key Parameters
- happiness level
- health level
- food level

Time
- real (user) time is kept in hours and minutes;
- virtual character doll time is also kept in hours and minutes of real time
- happiness level decreases with passage of time;
- food level decreases with passage of time;
- take a nap if:
  - all needs are satisfied;
  - a request has been repeated five times without response from user;
  - right hand is held and a hug given by player;
- go to sleep (at nighttime) as determined by the pre-selected bedtime;
- wake-up next morning as determined by the pre-selected wake-up time.

Reset
- reset switch is on/off switch;
- resets everything including clock.

Eating and Drinking
- if certain time passes without feeding or drinking, then:
  - health level decrease;
  - happiness level decreases;
  - food choices are time/meal dependent, for example:

| time/food | drinks | food |
|---|---|---|
| breakfast | milk, juice | applesauce, banana, cereal |
| morning snack | morning snack | applesauce, banana, carrot, cookie |
| lunch | milk, juice | applesauce, banana, hot dog, pizza, peas |
| afternoon snack | milk, juice | applesauce, banana, carrot, Popsicle, cookie |
| dinner | milk, juice | applesauce, banana, hot dog, pizza |
| late snack | milk, juice | applesauce, banana, carrot, cookie, Popsicle |

Health
- if health level=[0], then say "I'm sick";
- taking medicine increases health level;

Play
- three built-in games are provided (e.g., "Simon Says" game, "Color" game, and "Squeeze" game) for user to play with the doll;

Sleep
- go to sleep at naptime; and
- go to sleep at bedtime.

Given the above described processes, functions and gameplay rules, a person skilled in the art could apply conventional programming techniques to program the control unit 15 in the interactive virtual character doll 10 to perform the functions in accordance thereof without undue experimentation. Various pointers, flags, etc. may be required to identify triggering events, etc. These can be utilized in the program in accordance with conventional programming approaches. Reference may be made to U.S. patent application Ser. No. 09/115,964 (filed on Jul. 15, 1998), which discloses the "Talking Nano" hand-held virtual character toy developed by Playmates Toys, Inc. which application is fully incorporated by reference herein. Some or many of the game logics may be similar to that of the Talking Nano.

It is noted that the virtual character doll is not limited to humans nor other living beings (animal character). Man-made characters (e.g., cartoon character, animated object, etc.) that are personified to communicate sounds, and in particular words (e.g., a robot, a talking car), to players to express information such as their actions, personalities, feelings, emotions and thoughts are well within the scope of the present invention.

Control unit 15 is preferably implemented in the form of a battery operated programmable microprocessor or microcontroller, as variously termed, and associated memory, including voice ROM, and a digital-to-analog converter and appropriate input and output interface circuits, which may be implemented in a custom semiconductor integrated circuit chip, although separate chips may be used as an alternative, all of which are known and have appeared heretofore in interactive toys. Optionally, the digital clock 16 need not be a separate unit as earlier described, but instead, is also integrally formed on the chip, retaining the liquid crystal clock display, pictorially illustrated in FIG. 1 at the doll's front side. The chip's inputs are respectively connected to respective sensors (and digital clock) described and its respective outputs to the loudspeaker and LCD display. The micro-controller is programmed in accordance with the foregoing description and that program, the software, is stored in another portion of non-volatile memory or ROM.

Verbal messages are broadcast from the loudspeaker under control of the microcontroller by outputting the contents of various locations in the voice ROM, and applying that digital information to the digital-to-analog converter, forming a speech synthesizer, and from there to the loudspeaker. The digital form of the message is converted to the analog form that drives the loudspeaker and produces the desired verablization of audible sounds, words and other voice messages.

The verbal messages and sounds are preferably human voices that are recorded as digital information in a portion of the ROM memory, often called the voice ROM, using any standard technique. Those verbal messages, such as those earlier described, may be stored as complete sentences or, alternatively, as words and partial phrases, dependent in part on the amount of memory available or which one prefers to include. As the price of memory drops, permitting incorporation of larger memory sizes for a practical embodiment, in addition to short phrases, the verbal messages may include songs that are sung by the doll, music and/or special sound effects.

To minimize the amount of memory required the messages may be stored as appropriate as individual words, partial phrases, and/or full expressions. As an example, the verbal message: "I want a banana" may be parsed in separate parts and stored in different areas of the memory as "I want a" and as "banana". Under program control, when the message for a banana is called for during the course of the program, the microcontroller selects and consecutively outputs the two sections from the memory in proper order other verbal requests for a pizza or Popsicle, as examples may likewise be constructed using the same initial phrase "I want a", thereby requiring storage space for that phrase only once. The individual words and sub-phrases may be used over and over again allowing them to be played back in various sequences.

To further minimize memory requirements, the digitized audio should be compressed using any conventional compression algorithm during the recording process; and the program should include implementation of an algorithm for decompressing that compressed digitized audio as it is played back.

Although the foregoing embodiment has been described in connection with the English language, it is appreciated that other languages may alternatively be employed in dolls intended for children in non-English speaking countries.

In other more expensive embodiments one can include additional voice ROM and store the same messages in additional languages to provide a multi-language doll. The start up programming for the user would then include an additional set up step containing a display of and requesting selection of the particular language for the doll to speak. Language selection is accomplished by toggling the left and right hand sensors in the same manner as in setting the wake and sleep times. Such a multi-language doll may be attractive also to parents who wish their child to learn a second, language.

In addition to the incorporation of multi-languages as larger size memories become practical for doll products, as earlier noted, the doll can store and be programmed to sing songs, accompany the speaking parts with music and/or sound effects, with or without parsing of short messages as above described, and with or without digital compression.

As those skilled in the art appreciate, the foregoing implementation is illustrative and many other forms of specific semiconductor circuits may be substituted to accomplish the described functions of my invention.

In a still additional embodiment, the foregoing doll is modified to incorporate a clock calendar, such as a digital clock calendar chip, in lieu of the clock in the prior embodiment. In a similar manner to the way in which the IC is programmed with information enabling it to keep track of the daily passing of time (i.e., a clock function), the device may also, in addition to the heretofore mentioned clock function, be programmed to keep track of the weekly, monthly, and yearly passing of time (i.e., a calendar function). The calendar would be set in a similar manner to the clock, where as earlier described, in the "set the time model, the clock would be set to the hour of the day, the minutes of the day, and whether or not it was AM or PM. Once that information was set in the clock, such as by toggling the left and right hand sensors in the prior embodiment, the "Set the date model" would automatically occur on the program menu, permitting the parent to also set the month by inputting a number between 112, then set the day of the month by inputting a number between 1–31, and then set the year by inputting the appropriate four numbers for the current year, such as 1999.

In addition, readily available information regarding the specific date of each year on which a holiday, such as Easter or Thanksgiving falls when such days vary year by year, can be stored in ROM memory and be programmed into the device, storing such information for however many years into the future as desired or for which memory storage space on the IC device is available. Similar information regarding all holidays that fall on the same date of a specific month each year, such as Christmas, can likewise be programmed into the device.

As an additional feature, the software program may be modified to permit the doll to anticipate all such holidays at any period of time in advance desired by the programmer, such as 30 days or 14 days in advance of such a holiday, so that the doll will anticipate the upcoming holiday event. The doll will have stored words and/or phrases stored in her vocabulary at specific locations or addresses in ROM memory. Once the real time period on the doll's clock/calendar has reached the anticipated time period (30 days or 14 days as mentioned heretofore as an example) has occurred as detected by the program, such special event falls in the advance period, the program will initiate play of specific messages. The doll will speak or broadcast messages to communicate anticipation of the holiday event at whatever time period during the day is called for by the program, or when a specific input is made to the doll. As example, if it is Christmas Eve, the doll could simply mention upon waking up that "I want to get up Mommy", and then mention, I can't wait for tomorrow morning. It will be Christmas." Or, when the doll is given a cookie on a day that is two weeks before Christmas, the doll may say, "I can't wait to have a Christmas Cookie. It's only two weeks until Christmas."

The clock-calendar can also have a "set the year you were born" mode. With that the program menu would have a step at which the program would call for and the LCD display present a request to set your birthday. Then the parent would input the child's birthday by setting the correct month, day, and year the child was born. This information would enable the doll to know when the child's birthday was upcoming, and anticipate it with all due excitement. In addition, it would allow the doll to know how old the child is now and will be on her upcoming birthday. If desired, birthdays for the entire family can be inputted into the doll's calendar so she can also anticipate the child's mother, father, brother, or sister's birthday and also know their age.

As another feature the clock/calendar can also have a "set the religion" mode in which a letter or number (code) can be selected to identify which religious holiday's the parent wishes the doll to anticipate or acknowledge. If the religion were Christian, then the doll would anticipate Easter and Christmas. If the religion selected were Jewish then all Jewish holidays would be anticipated.

The clock/calendar can also have a "set the country" mode in which a letter or number (code) is selected by the parent to "set the country." In the US the 4th of July, Washington and Lincoln's birthday, Memorial Day and Labor Day will be anticipated. In France, Bastil'Le Day will be anticipated along with other appropriate French national holidays. In Canada, Thanksgiving will be celebrated on the day it is celebrated in Canada, which is not the same day Thanksgiving is Celebrated in the United States. Setting the country mode will also enable the doll to have country specific activities if they are deemed important. Once such example is that in the United Kingdom tea is often served at 4:00 ]PM in the afternoon. The doll would want to have "tea" with the child as she approaches that time in the afternoon if the doll had be set to the UK mode.

A "set the state", mode would let the doll know the general weather pattern where the doll and her owner family/child lived. If the doll's state were set in Florida, we would anticipate sunny weather and the ability to play outside a lot. If the doll's state was set in Maine, then the doll would be enjoying the leaves outside during the fall, and talking about being sure to bundle up in the winter, or anticipate spring coming with the child.

All of the modes allowed by the foregoing addition enriches the doll's intelligence and potential play patterns between the child and the doll. The foregoing examples should not be considered to limit the invention as it is not limited to the foregoing. Any information that is desired that would relate to a calendar or clock can be inputted into the IC device of the doll by means of giving the parent of the child either written instructions regarding setting various modes or scrolling through the various modes and having the doll speak various audio input signals to the parent to suggest programming. What is included will be a function of providing the maximum number of play patterns and modes balanced by the cost the IC chip and amount of memory required to store the doll's vocabulary necessary to store the speech and programming information required for the expanded play pattern and how that cost affects the ultimate retail price of the doll. As time passes and the price of consumer electronics, microprocessors, Memory, and other devices continues to drop in price, greater numbers of functions and play modes can be added lo provide enhanced intelligence and play to the doll by simply imputing additional information as it relates to location, season, holidays, sports seasons, vacation plans and locals that the family will visit on certain dates, and so forth. Anything or any activity can be inputted into the doll's clock-calendar and therefore be anticipated with excitement by the doll as the event approaches, giving her extraordinary "virtual" intelligence.

While the invention has been described with respect to the described embodiments in accordance therewith, it will be apparent to those skilled in the art that various modifications and improvements may be made without departing from the scope and spirit of the invention. The time sequence of the personified virtual character doll may be modified in accordance with other parameters. For example, the virtual character may be configured and programmed to engage in various activities such as sightseeing/traveling, with the object of the interaction being to successfully complete a trip around the world. The virtual character gameplay rules may relate to other than a daily-life sequence. For example, the virtual character may be configured and programmed to perform certain tasks (e.g., fishing), while communicating to the player the state of the game and its needs (e.g., more baits) in order for it to accomplish the tasks. Accordingly, it is to be understood that the invention is not to be limited by the specific illustrated embodiments, but only by the scope of the appended claims.

What is claimed is:

1. An interactive talking doll, comprising:

a doll, said doll including a head, containing a mouth, and torso;

said torso including two arms, each with a hand and two legs; and a plurality of coded keys, each said key simulating a respective one of a plurality of items normally placed in the mouth by a person, including food, beverage and medicine, each of said coded keys being of a size to fit within said mouth;

said doll further including:

battery powered microprocessor;

speaker;

speech synthesizer coupled to said speaker for converting digital electronic statements into audible statements;

a plurality of sensors coupled to said microprocessor, whereby said computer is able to determine when a respective sensor is activated;

said sensors being distributed at different positions about said doll, including:

first and second sensors respectively in said two hands;

third sensor on the top side of said head;

a fourth sensor in the front side of said torso;

a fifth sensor on the bottom of said torso;

a coded key sensor coupled to said microprocessor, said coded key sensor being located within said mouth, whereby said microprocessor is able to identify coded keys inserted within said mouth;

liquid crystal display;

a settable electronic clock for tracking the time of day; said electronic clock being coupled at least to said liquid crystal display and having an output coupled to said microprocessor for providing time of day information to said microprocessor;

a memory;

said memory storing a plurality of verbal statements in digital electronic form; said verbal statements including:

a plurality of request statements, said request statements each identifying an action to be taken that produces activation of a particular one of said sensors or said coded key sensor;

a plurality of acknowledgment statements;

a plurality of general statements;

a plurality of request statements, including at least one request statement associated respectively with each of said plurality of coded keys;

said plurality of acknowledgment statements including a statement associated with each of said plurality of coded keys indicating that the coded key inserted was incorrect;

said plurality of general statements including a statement that it is time to sleep and that one doll does not wish to play;

said memory further storing a wake time at an hour during the morning and a sleep time at an hour during the evening;

said memory further including a program for said microprocessor;

said program correlating at least some of said request statements with a specific hour of the day, whereby said microprocessor issues a request statement at a specific hour during the day;

said program checking said electronic clock to determine the hour of the day and determining whether the hour is after said wake time and prior to said sleep time, and, if so, determining whether any request statement is correlated to the hour;

said program further selecting a first one of said request statements from amongst request statement correlated to the particular time of day for broadcast through said speaker and issuing said one request statement through said speech synthesizer and said speaker; determining whether the request has been satisfied within a predetermined interval, and, if not, repeating said first one of said request statements for broadcast through said speaker, and, if satisfied, selecting a first acknowledgment statement for broadcast through said speaker, whereby said doll simulates human understanding of an activity; and, after a subsequent interval, selecting another one of said request statements for broadcast through said speaker;

wherein said program in determining whether the request has been satisfied within a predetermined interval further includes checking of said sensors and said coded key sensor to detect compliance with a request statement that requires a particular sensor be activated or a particular coded key be inserted within said doll's mouth;

said program checking said clock to determine whether the time of day is after said sleep time and prior to said wake time, and inhibiting the generation of request statements during the time interval between said sleep time and said wake time, defining a sleep interval, and, responsive to actuation of any of said sensors or said coded key sensor during said sleep interval, for selecting and issuing the one of said general statements representing that it is time to sleep and that one doll does not wish to play.

2. The invention as defined in claim 1, further including calendar means for keeping track of the current date and special events, including birthdays, holidays and religious events for enabling the doll to broadcast statements concerning said special event in advance thereof.

3. The invention as defined in claim 1, wherein said program further maintains a count of sensor actuations occurring within a predetermined interval, said count defining a state of happiness for said doll; and further including means for symbolically displaying said count on said Liquid crystal display to display said state of happiness.

4. The invention as defined in claim 1, wherein said memory storing a plurality of verbal statements in digital electronic form, further comprises a means for storing verbal words and phrases in digital electronic form from which verbal statements are constructed; and wherein said program further comprises: a verbal statement program for assembling a selected verbal statement from words and phrases stored in said memory.

5. The invention as defined in claim 1, further comprising a hairbrush; and wherein said third sensor positioned at said top side of said head detects placement of said hairbrush on said top side of said head.

6. The invention as defined in claim 5, further comprising a diaper, said diaper being affixed to said torso, and wherein said fifth sensor positioned on said bottom side of said torso detects the presence of said diaper.

7. The invention as defined in claim 6, wherein said fourth sensor positioned at the front of said torso detects the application of a squeezing force to said torso.

8. The invention as defined in claim 7, wherein said general statements include a statement that it is time to get up and that the doll does not wish to sleep.

9. The invention as defined in claim 8, further comprising an electronic calendar for providing the date, said electronic calendar being user programmable; and wherein said memory includes data identifying special events, including holidays and religious events, and the dates thereof; wherein at least said general statements includes statements correlated to each of said special events; and wherein said program checks the current date and determines the one of said special events that is occurring and from time to time issues general statements correlated to that one special event or, if none is occurring, the one of said special events that is next to occur following said current date and the number of days between said current date and said next to occur special event and, if said number of days is less than a predetermined number, from time to time issues general statements correlated with that next to occur special event.

10. The invention as defined in claim 9, further comprising user programmable means for inserting a birth date in memory as a special event.

11. An interactive talking doll, comprising:

a torso;

a speaker;

at least one sensor for interactive input by a player; and processing means to check time of day and, responsive to determination of particular times of day, audibly communicate to a player through said speaker a request to undertake a player input and to identify an input by the player received by said sensor in response to said request or failure of an input by said player and thereafter audibly communicate to a player a reaction with respect to a player's input or lack thereof, wherein said doll and a player may interactively simulate daily time-based activities relating to basic human functions, wherein said torso includes a head and said head includes an open mouth; and wherein said at least one sensor comprises a plurality of individual sensors, said plurality of sensors being distributed about the torso of said doll, and one of said plurality of sensors being located in said open mouth.

12. An interactive talking doll, comprising:

a torso;

a speaker;

at least one sensor for interactive input by a player; and processing means to check time of day and, responsive to determination of particular times of day, audibly communicate to a player through said speaker a request to undertake a player input and to identify an input by the player received by said sensor in response to said request or failure of an input by said player and thereafter audibly communicate to a player a reaction with respect to a player's input or lack thereof, wherein said doll and a player may interactively simulate daily time-based activities relating to basic human functions, wherein said torso includes a head having a mouth opened and sized to receive a play-piece from a plurality of play-pieces;

wherein said mouth includes said sensor;

wherein each of said play-pieces simulating a respective one of a plurality of food items customarily fed to a living child, each of said play-pieces including a code that is sensor detectable and that identifies the respective food item, and each of said play-pieces for insertion by a player into said mouth; and wherein at least some of said requests communicated to the player requires player selection of an appropriate one of said plurality of play-pieces and insertion of said selected play piece into said mouth, thereby simulating feeding a child.

13. An interactive talking doll as in claim 12, wherein said processing means includes:

means for comparing the code of said requested one of said plurality of coded play-pieces with the code of the play-piece inserted in said mouth by the player means for audibly communicating to the player a message indicative of player action when said codes compared are identical or a message indicative of incorrect player action when said codes compared are dissimilar; and means for audibly communicating a repeated request for said one of said plurality of play-pieces when the player fails to insert any play-piece in said mouth within a predetermined time interval following said request.

14. An interactive talking doll, comprising:

a torso;

at least one appendage extending from the torso;

an article of clothing dressed on said torso, said article being removable from said torso, wherein said torso may be undressed and dress at the option of a player;

a speaker;

at least one sensor for interactive input by a player; and processing means to check time of day and, responsive to determination of particular times of day, audibly communicate to a player through said speaker a request to undertake a player input and to identify an input by the player received by said sensor in response to said request or failure of an input by said player and thereafter audibly communicate to a player a reaction with respect to a player's input or lack thereof, wherein said doll and a player may interactively simulate daily time-based activities relating to basic human functions.

15. The invention as defined in claim 14, further comprising a diaper for said torso, and wherein said torso includes a diaper sensor to detect presence of said diaper; said sensor comprising a casing of a first heart shape geometry, said diaper containing an actuator for actuating said diaper sensor, said actuator comprising a second heart shape geometry for mating snap-fit engagement with said casing.

16. The invention as defined in claim 14, further comprising a plurality of playpieces each containing a separate coding, a head to said torso, said head including a mouth cavity therein for receiving a play piece selected by a player, a mouth sensor located within said mouth cavity for receiving the coding of a play piece inserted into said mouth, said coding for each of said play pieces comprising a respective value of electrical resistance.

17. An interactive talking doll as in claim 14, wherein said human functions simulated include at least one of the following activities: feeding, sleeping, crying, laughing, drinking, and playing, and further comprising a settable electronic clock-calendar for tracking the date and time of day; and wherein said processing means checks the date and time of day tracked by said electronic clock-calender.

18. An interactive talking doll as in claim 10, further comprising a settable electronic clock for tracking the time of day; and wherein said processing means checks the time of day tracked by said electronic clock.

19. An interactive talking doll as in claim 14, wherein said processing means further includes play rules for playing a game with a player, said game requiring verbal communications from the doll to the player, and sensor inputs by the player responsive to said verbal communications.

20. An interactive talking doll as in claim 14, wherein said audible communications comprise spoken human-language words.

21. An interactive talking doll as in claim 14, wherein said doll is of an appearance that resembles one of the following characters:

(a) human beings;

(b) animals;

(c) fantasy characters;

(d) human or non-human cartoon characters; or (e) personified objects.

22. The invention as defined in claim 14, further comprising a plurality of playpieces each containing a separate coding, a head to said torso, said head including an exterior vinyl surface and a mouth cavity therein for receiving a play piece selected by a player, a mouth sensor located within said mouth cavity for receiving the coding of a play piece inserted into said mouth, and a rigid plastic mouthpiece fitted within said cavity to provide a support for play pieces inserted therewithin.

23. An interactive talking doll as in claim 14, further comprising at least one appendage extending from the torso.

24. An interactive talking doll as in claim 23, further comprising at least one sensor provided on said at least one appendage.

25. An interactive talking doll, comprising:

a doll, including at least a head and torso; a plurality of coded keys, each said key simulating a respective one of a plurality of items normally placed in a person's mouth, each of said coded keys being of a size to be applied to a receiving passage in said doll;

said doll further including:

a battery powered microprocessor; a speaker; speech synthesizer means coupled to said speaker for converting digital electronic statements into audible statements;

a plurality of sensors coupled to said microprocessor, whereby said computer is able to determine when a respective sensor is activated, said sensors being distributed at different positions about said doll;

one of said sensors further comprising a coded key sensor coupled to said microprocessor, said coded key sensor being located within opening in said doll, whereby said microprocessor is able to identify coded keys inserted within said opening; and at least one touch sensor, whereby said microprocessor is able to identify the location on said doll being touched;

liquid crystal display;

a settable electronic clock for tracking the time of day; said electronic clock being coupled at least to said liquid crystal display and having an output coupled to said microprocessor for providing time of day information to said microprocessor;

a memory means for storing a program and data; said data including a plurality of verbal statements in digital electronic form;

said verbal statements including:

request statements, said request statements action to be taken that produces activation of said touch sensors or said coded key;

acknowledgment statements;

general statements;

said plurality of request statements, including at least one request statement associated respectively with each of said plurality of coded keys;said plurality of acknowledgment statements including a statement associated with each of said plurality of coded keys indicating that the coded key inserted was incorrect;

said plurality of general statements including a statement that it is time to sleep and that one doll does not wish to play; said data stored in said memory further comprising a wake time at a time during a morning hour and a sleep time at a time during an evening hour;

said program including a correlation of at least some of said request statements with a specific hour of the day, whereby said microprocessor issues a request statement at a specific hour during the day;

said program further including a check of said clock to determine the time of the day and determine whether the time of day is after said wake time and prior to said sleep time, and, if so, determine whether any request statement is correlated to the determined time of day, and, if affirmative, issuing the request statement to said voice synthesizer for broadcast from said speaker;

said program further selecting a first one of said request statements for broadcast through said speaker and issuing said one request statement through said speech synthesizer and said speaker; determining whether the request has been satisfied within a predetermined interval, and, if not, repeating said first one of said request statements for broadcast through said speaker, and, if satisfied, selecting a first acknowledgment statement for broadcast through said speaker; and, after a subsequent interval, selecting another one of said request statements for broadcast through said speaker;

said program, responsive to a determination that the time of day indicated by said clock occurs after said sleep time and prior to said wake time, for inhibiting the generation of request statements during the time interval between said sleep time and said wake time, defining a sleep interval, and, responsive to actuation of any of said sensors during said sleep interval, for selecting and issuing the one of said general statements representing that it is time to sleep and that one doll does not wish to play.

26. The invention as defined in claim 25, wherein said plurality of acknowledgment statements include a statement indicating that the coded key inserted was correct.

27. The invention as defined in claim 25, further including calendar means for keeping track of the current date and special events, including birthdays, holidays and religious events for enabling the doll to broadcast statements concerning said special event in advance thereof.

28. The invention as defined in claim 25, further comprising an electronic calendar for providing the date, said electronic calendar being user programmable; and wherein said memory includes data identifying special events, including holidays and religious events, and the dates thereof; wherein at least said general statements includes statements correlated to each of said special events; and wherein said program checks the current date and determines the one of said special events that is occurring and from time to time issues general statements correlated to that one special event or, if none is occurring, the one of said special events that is next to occur following said current date and the number of days between said current date and said next to occur special event and, if said number of days is less than a predetermined number, from time to time issues general statements correlated with that next to occur special event.

29. The invention as defined in claim 28, further comprising user programmable means for inserting a birth date in memory as a special event.

30. An interactive talking doll, comprising:

a torso;

speaker;

sensor means for sensing interactive input by a player, said sensor means comprising a clothing sensor; and processing means including means for audibly communicating to a player through said speaker a request for the player to clothe said torso with a certain kind of garment;

said processing means further including means for identifying player inputs at said clothing sensor, said player input including the input of clothing said torso with a garment, wherein said processing means determines the kind of garment applied to said torso;

said processing means further including means for determining compliance with said request for the player to clothe said torso with a certain kind of garment, and, if determined to be in compliance, communicating a first verbal reaction to the player, and, if determined to be not in compliance, communicating a second verbal reaction to the player.

31. An interactive talking doll as in claim 30, further comprising in combination at least first and second garments for alternative application to said doll, each of said garments including a coded coupling to identify the respective garment; and wherein said clothing sensor includes means to receive the coded coupling associated with a garment when said garment is applied to clothe said torso.

32. An interactive talking doll as in claim 30, wherein said sensor means further comprises a plurality of additional sensors for interactive input by a player; wherein said processing means further includes means for audibly communicating to a player through said speaker requests to undertake player inputs through any of said additional sensors; and wherein said processing means further includes means for determining compliance with said request to undertake player inputs through any of said additional sensors, and, if determined to be in compliance, communicating a verbal reaction of satisfaction to the player, and, if determined to be not in compliance, communicating a verbal reaction of dissatisfaction to the player.

33. An interactive talking doll as in claim 32, wherein:

said torso includes a simulated head, and the top of said head includes simulated hair;

said plurality of additional sensors further includes a brush sensor for sensing the presence of a hair brush;

said brush sensor being located underlying said simulated hair; and said processing means for detecting a brush positioned on said simulated hair;

at least one of said requests of said processing means to said player including a request for the player to apply said brush to said simulated hair;

said player inputs include the input of applying a brush to said simulated hair, wherein said processing means determines any application of said brush to said hair;

said processing means further including means for determining compliance with said request for the player to brush said simulated hair, and, if determined to be in compliance, communicating a third verbal reaction to the player, and, if determined to be not in compliance, communicating a fourth verbal reaction to the player.

34. An interactive talking doll as in claim 33, further comprising in combination a brush, said brush including a magnet; and wherein said brush sensor comprises a magnetic reed switch.

35. An interactive talking doll as in claim 32, wherein said processing means further:

maintains information of the present time and present date;

stores the dates of a plurality of special days in a calendar year;

determines the number of days between said present date and the date of the one of said special days that is next to occur in time, and, when said number of days falls within a predetermined range of days, audibly communicates a spoken message to alert a player to the identity of said one of said special days and the number of days until said one special day arrives, whereby said talking doll simulates human initiative and thinking.

36. An interactive talking doll as in claim 35, wherein said special days includes a birthday date.

37. An interactive talking doll, comprising:

a torso;

a speaker having an electrical input representative of the sound to be delivered by the speaker;

at least one sensor for interactive input by a player, said sensor comprising a clothing sensor;

a memory device storing a plurality of different verbal reactions; and a controller, said controller including:

an electronic clock for determining the time of day;

means for audibly communicating to a player through said speaker;

means for identifying player inputs at said at least one sensor, including said clothing sensor, said player inputs including the input of clothing said torso with a garment, whereby the kind of garment applied to said torso is identified;

said controller further including means for selecting a first verbal reaction from amongst the plurality of verbal reactions stored in the memory device for audible communication to the player responsive to the kind of garment applied to said torso by the player, whereby the doll may convey a like or dislike of the garment to the player, wherein said controller checks the time of day provided by said electronic clock prior to selecting said first verbal reaction.

38. An interactive talking doll, comprising:

a torso;

a speaker having an electrical input representative of the sound to be delivered by the speaker;

at least one sensor for interactive input by a player, said sensor comprising a clothing sensor;

a memory device storing a plurality of different verbal reactions; and a controller, said controller including:

means for audibly communicating to a player through said speaker;

means for identifying player input at said at least one sensor, including said clothing sensor, said player input including the input of clothing said torso with a garment, whereby the kind of garment applied to said torso is identified, wherein said player input to said clothing sensor is in response to a verbal statement from said controller;

said controller further including means for selecting a first verbal reaction from amongst the plurality of verbal reactions stored in the memory device for audible communication to the player responsive to the kind of garment applied to said torso by the player, whereby the doll may convey a like or dislike of the garment to the player.

39. An interactive talking doll, comprising:

a torso;

an article of clothing dressed on said torso, said article being removable from said torso, wherein said torso may be undressed and dress at the option of a player;

a speaker having an electrical input representative of the sound to be delivered by the speaker;

at least one sensor for receiving a player input;

a memory device storing a plurality of different verbal statements;

a controller, said controller including:

a clock for keeping the time of day, whereby said controller is able to determine the time of day;

predefined game logic;

means for audibly communicating verbal statements to a player through said speaker, said verbal statements simulating verbally the character of a live person of intelligence and understanding; and means for identifying a player input to said at least one sensor, determining whether said identified player input was appropriate or inappropriate in accordance with the predefined game logic and selecting a verbal statement from amongst the plurality of different verbal statements stored in the memory device for communication to said player indicating appropriateness or inappropriateness of said identified player input.

40. An interactive talking doll as in claim 39, wherein said determination of appropriateness or inappropriateness by said controller includes a check of said clock to determine the time of day of said player input.

41. An interactive talking doll as in claim 39, wherein said controller further includes:

a sleep mode, whereby the doll may simulate sleep for a period of time, said period of time commencing at a particular hour of the evening and terminating at a particular hour of the following morning; and wherein said verbal statements include a first statement representing that the doll is going to sleep, and a second statement representing that the doll is waking, said controller issuing said first statement on commencement of said sleep mode and said second statement on termination of said sleep mode.

42. An interactive talking doll, comprising:

a torso;

an article of clothing dressed on said torso, said article being removable from said torso, wherein said torso may be undressed and dress at the option of a player;

a speaker having an electrical input representative of the sound to be delivered by the speaker;

at least one sensor for receiving a player input;

a memory device storing a plurality of different verbal statements;

a controller, said controller including:

predefined game logic;

means for audibly communicating verbal statements to a player through said speaker, said verbal statements simulating verbally the character of a live person of intelligence and understanding; and means for identifying a player input to said at least one sensor, determining whether said identified player input was appropriate or inappropriate in accordance with the predefined game logic and selecting a verbal statement from amongst the plurality of different verbal statements stored in the memory device for communication to said player indicating appropriateness or inappropriateness of said identified player input, wherein said at least one sensor comprises a clothing sensor, wherein said player input comprises clothing said torso with a selected one of a plurality of garments, and wherein said means for identifying a player input includes means for determining the kind of garment applied to said torso.

* * * * *